US005240210A

United States Patent [19]

Honto, Jr. et al.

[11] Patent Number: 5,240,210

[45] Date of Patent: Aug. 31, 1993

[54] TYPING WORKSTATION ARMREST

[76] Inventors: Bill Honto, Jr., 7830 Rutherford, Detroit, Mich. 48228; James M. Satterfield, 380 Albany St., Ferndale, Mich. 48220

[21] Appl. No.: 893,580

[22] Filed: Jun. 4, 1992

[51] Int. Cl.[5] ..... B43L 15/00

[52] U.S. Cl. ..... 248/118.1; 248/918; 312/208.2; 400/715

[58] Field of Search ..... 248/118, 118.1, 118.3, 248/118.5, 918; 400/715; 312/208.2, 330

[56] References Cited

U.S. PATENT DOCUMENTS

| | | | |
|---|---|---|---|
| 1,277,169 | 8/1918 | Anderson . | |
| 2,950,890 | 8/1960 | Hough, Jr. . | |
| 4,482,064 | 11/1984 | Berke et al. | 248/118 |
| 4,515,086 | 5/1985 | Kwiecinski et al. | 248/918 X |
| 4,545,554 | 10/1985 | Latino et al. | 248/118.1 |
| 4,621,781 | 11/1986 | Springer | 248/118 |
| 4,913,390 | 4/1990 | Berke | 248/176 |
| 5,048,784 | 9/1991 | Schwartz et al. | 248/118.3 X |
| 5,062,609 | 11/1991 | Hames et al. | 248/918 X |
| 5,120,010 | 6/1992 | Magee | 248/118 |
| 5,131,614 | 7/1992 | Garcia | 248/118 |
| 5,137,384 | 8/1992 | Spencer et al. | 400/715 X |

*Primary Examiner*—Ramon O. Ramirez

*Attorney, Agent, or Firm*—Reising, Ethington, Barnard, Perry & Milton

[57] ABSTRACT

A typing workstation armrest includes a generally planar rectangular member placed on a table with the typing equipment thereon to maintain the member in position. The member includes a generally U-shaped cutout in the end extending from and over the edge of the table to allow the torso of the user to be moveable within the cutout while providing arm extensions extending thereabout for supporting the forearms of the user.

10 Claims, 2 Drawing Sheets

TYPING WORKSTATION ARMREST

TECHNICAL FIELD

The invention relates to equipment for connection with typing workstations, such as computers and word processors, and more particularly to armrests for supporting the typing arms of a user.

BACKGROUND OF THE INVENTION

Users of typing workstations generally experience fatigue in their wrists, arms and even shoulders from prolonged typing by maintaining their arms level with the keyboard. Furthermore, more serious problems can occur, such as carpal tunnel syndrome from the strain on the wrist and arm. Therefore, it is desirable to provide a support which can relieve such strain during prolonged typing.

Attempts have been made to provide support to typists. One type of support is disclosed in U.S. Pat. Nos. 4,482,064 and 4,913,390. These patents disclose hand rest supports which are connected to the bottom of the keyboard and which provide support during typing. However, these supports only support the hand and provide minimal support due to the fact the supports are only connected to the front edge of the keyboard wherein tipping can occur if full user weight is applied to the support.

U.S. Pat. Nos. 2,950,890 and 4,621,781 disclose forearm supports which extend from a keyboard. The '890 patent disclosed two separate forearm supports which include a shaft extending from a bracket secured to the typewriter, and which includes a rest element at the end of the shaft for supporting the forearm. The '781 patent discloses a generally rectangular armrest support which can be bolted to the table adjacent the keyboard, and which includes a shaped upper surface.

A problem with several of these types of designs is that the support intrudes between the torso of the user and the keyboard requiring awkward extension of the arms. Furthermore, connection to the keyboard itself provides minimal support due to the fact that if full weight of a persons arms rest on the support, the support will have a tendency to tip. Lastly, the method of attachment of several of these armrests is complex.

SUMMARY OF THE INVENTION

The invention is a typing armrest apparatus for supporting the arms of a user utilizing a keyboard of typing equipment. The apparatus comprises an integral planar member having an upper supporting surface and a lower surface. The planar member includes a first side edge having a U-shaped cutout therein establishing a base edge extending within the member and a pair of support arms extending from the base edge for supporting the forearms of a user and for providing clearance for the torso of the user between the base and support arms thereof.

The invention also includes connection means for fixedly maintaining the planar member to a surface or table. The connection means may take the form of screw type fasteners, suction cups, clamps, or a housing allowing sliding of the member.

BRIEF DESCRIPTION OF THE DRAWINGS

The advantages of the invention will become more readily apparent when taken in conjunction with the accompanying drawings wherein.

DESCRIPTION OF THE PREFERRED EMBODIMENT

Figure 1:
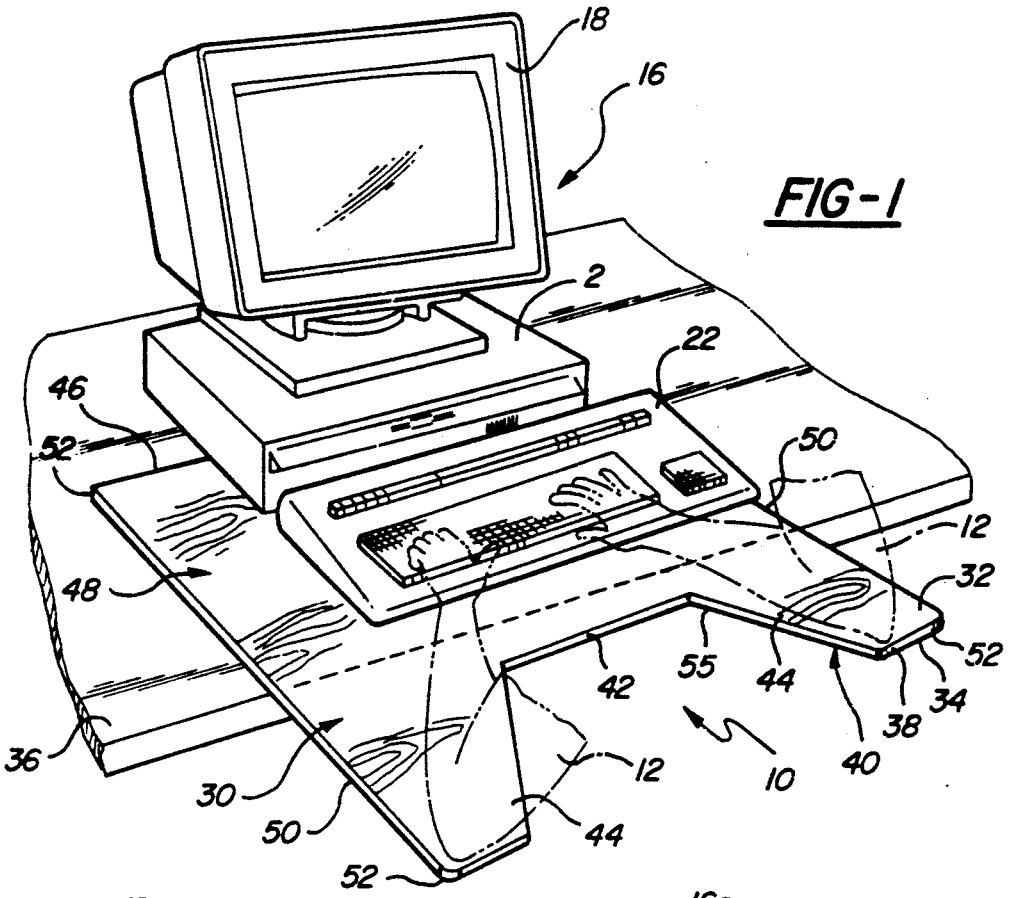
FIG. 1 is a perspective view of the apparatus in its use.

A typing workstation armrest apparatus for use in a typing workstation 16 to support the forearms 12 of a user is generally illustrated at 10 in FIG. 1. As illustrated, the forearms 12 of the user are supported allowing the hands thereof to perform the necessary typing operations and movements.

The typing workstation 16 is generally comprised of a terminal screen 18, disk drive 20, and keyboard 22. The keyboard 22 is generally connected to the disk drive 20 by a conductor making the keyboard 22 easily and separately moveable. The terminal screen 18 may be set on top of the disk drive 20 for space savings. It is to be understood that the subject invention may be applied to other types of typing workstations, i.e. typewriters, self-contained word processors, etc. It is within the scope of the invention to allow use of various types of typing equipment with the subject armrest apparatus 10.

The armrest apparatus 10 includes an integral, generally planar support member 30. The member 30 includes an upper supporting surface 32 and a flat lower surface 34. The upper supporting surface 32 generally receives thereon the keyboard 22 and optionally the other word processing equipment, i.e., the screen 18 and disk drive 20 combination. The lower surface 34 rests on a supporting surface 36, such as a table or desk.

The planar member 30 includes a first side edge 38 having a cutout 40 of U-shaped configuration therein. The U-shaped cutout 40 establishes a base edge 42 extending within the member 30 and a pair of supporting arms 44 extending from the base edge 42 for supporting the forearms 12 of the user. The base 42 provides space and clearance for the torso of the user to maneuver therein between the arms 44 with respect to the keyboard 22, while allowing the full forearm or lower arm of the user to be supported by the supporting arms 44.

The member 30 includes a second and opposing side edge 46 with respect to the first side edge 38. The member 30 includes a generally integral rectangular portion 48 establishing the second side edge 46 and first side edge 38 and two additional parallel side edges 50. The U-shaped cut out 40 extends into the first side edge 38 thereby establishing the first side edge 38 at the ends of the support arms 44. Therefore, the member 30 provides three straight sides 46, 50 with the cut out 40 formed in the remaining side 38.

The exterior four corners 52 of the rectangular portion 48 of the member 30 are preferably rounded to enhance egress and entrance of the torso vis-a-vis the cut out 40 Furthermore, the internal corners 54 formed by the U-shaped cutout 40 are also generally rounded. The width of the support arms 44 are slightly tapered from the base edge 42 toward the first side edge 38 providing a channel width between the inside arm edges 55 at the first side edge 38 greater than the channel width between the inside arm edges 55 adjacent the base edge 42 allowing greater maneuverability of the user within the cutout 40. Additionally, the edges 38, 42, 50, 55 are rounded between the upper and lower surfaces 32, 34.

The member 30 is generally made of a planar sheet of structural material 60 (FIG. 2) have strength properties to support the forearms 12 of the user. In the preferred embodiment, the material 60 includes pressboard 62, as commonly known in the art, cut to the described and illustrate shape. The pressboard 62 has a thickness of generally ½–⅝ inch which provides suitable support. The pressboard 62 is preferably covered with a decorative coating 64, such as plastic or vinyl sheeting having an adhesive 66 on one side thereof which adheres to the pressboard 62. A decorative edge tape 68 of type similar to the sheeting 64 is utilized at the edges 38, 42, 50, 55. The sheeting 64 and tape 68 are commonly available and may include a wood grain decorative exterior surface. It is also within the scope of the invention to include use of other types of structural materials, such as molded plastic, metal, etc.

In order to maintain the member 30 in proper orientation and support (FIG. 1), placement of the typing equipment on the rectangular portion 48 of on the upper surface 32 may provide the necessary weight to prevent movement of the member 30 out of position. The member 30 is placed with the lower surface 34 against the support surface 36, and the rectangular portion 48 extends fully thereon. The base edge 42 may be positioned adjacent the edge of the support surface 36, or hanging slightly thereover so as to provide maximum support of the apparatus 10 on the support surface 36.

In the alternative embodiments illustrated in FIGS. 2–5, the apparatus 10 includes connection means **70*a–d* for fixedly maintaining the planar member 30 to the support surface 36. If the weight of the typing equipment is not sufficient, or if the user prefers a more permanent fixation, the connection means 70*a–d* may be used in addition to or in replacement of the typing equipment maintaining the member 30 against the table. In either case, it is preferable to maintain the keyboard 22 on the rectangular portion 36 to remain accessible to the user with the arms supported by the structural arms 44. There are four different embodiments of the connection means 70*a–d* set forth herein, however, it is to be understood that alternative fastening means may be utilized. In all cases, the configuration of the member 30** is the same.

Figure 2:
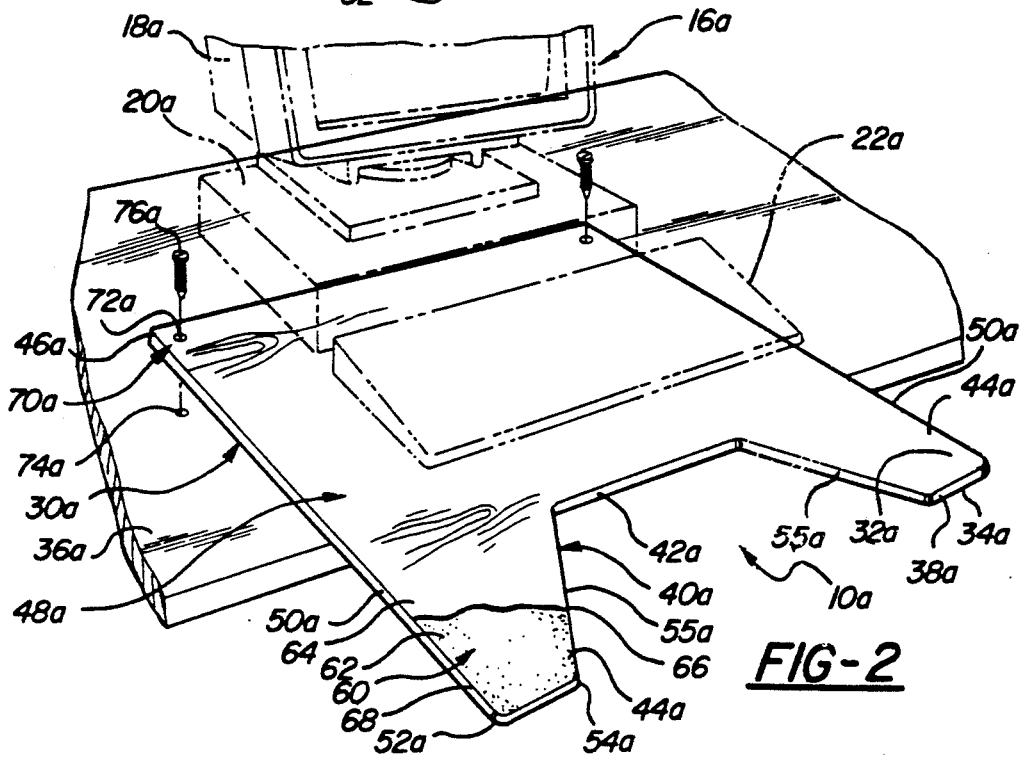
FIG. 2 is an expanded partially cut away perspective of a first embodiment of the connection means of the subject invention.

In the first embodiment **70*a* as illustrated in FIG. 2, the second end adjacent the second side edge 46*a* of the member 30*a* includes drilled apertures or holes 72*a* therein aligned with holes 74*a* in the support surface 36*a*. Fasteners 76*a*, such as bolts or screws, are directed through the aligned holes 72*a*, 74*a* and joined to nuts or the like to secure the member 30*a* to the support surface 36*a***.

Figure 3:
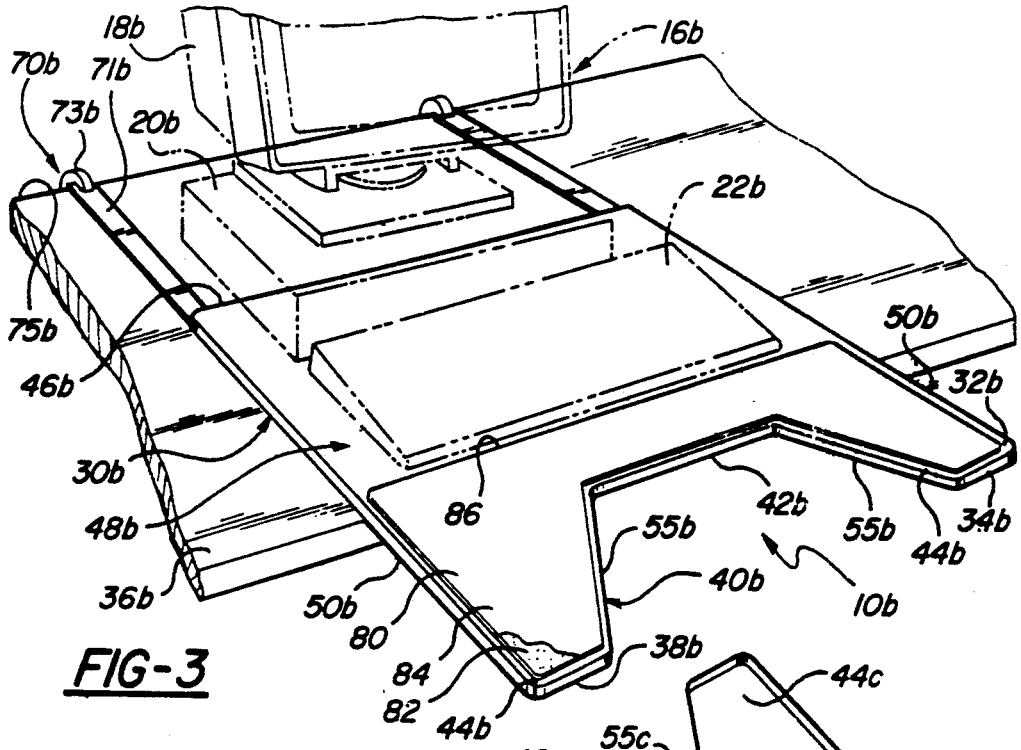
FIG. 3 is a perspective view of a second embodiment of the connection means of the subject invention.

In the second embodiment **70*b* as illustrated in FIG. 3, the second end adjacent the second edge 46*b* includes brackets 71*b* extending therefrom away from the U-shaped cut out 40*b*. The brackets 71*b* may be secured to the member 30*b* by adhesive, fasteners (screws), etc. The extending ends of the brackets 71*b* are clamped to the edge 75*b* of the support surface 36*b* by suitable clamps 73*b***, as are commonly known in the art.

Figure 4:
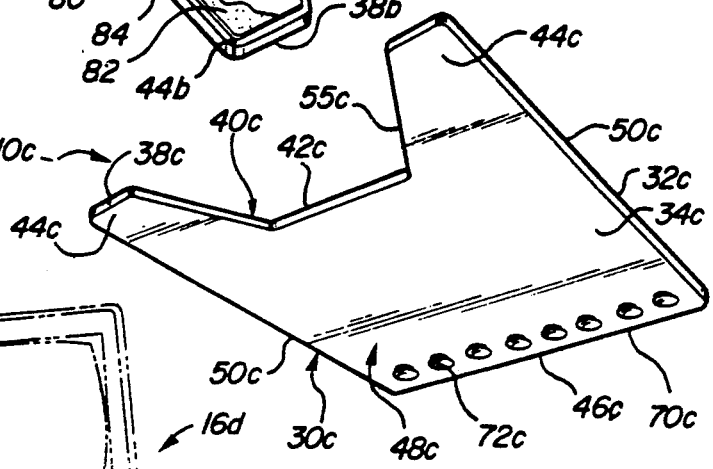
FIG. 4 is a perspective view looking at the lower surface of the member showing a third embodiment of the connection means of the subject invention.

In the third embodiment **70*c* as illustrated in FIG. 4, the lower surface 34*c* of the member 30*c* includes a plurality of spaced suction cups 72*c* secured thereto. The suction cups 72*c* may be fixedly secured to the lower surface by a suitable adhesive. Thereafter, the member 30*c* may be secured to a smooth top table by pressing the cups 72*c*** thereagainst. Alternatively, a typical plastic hook and loop fastener may be utilized.

Figure 5:
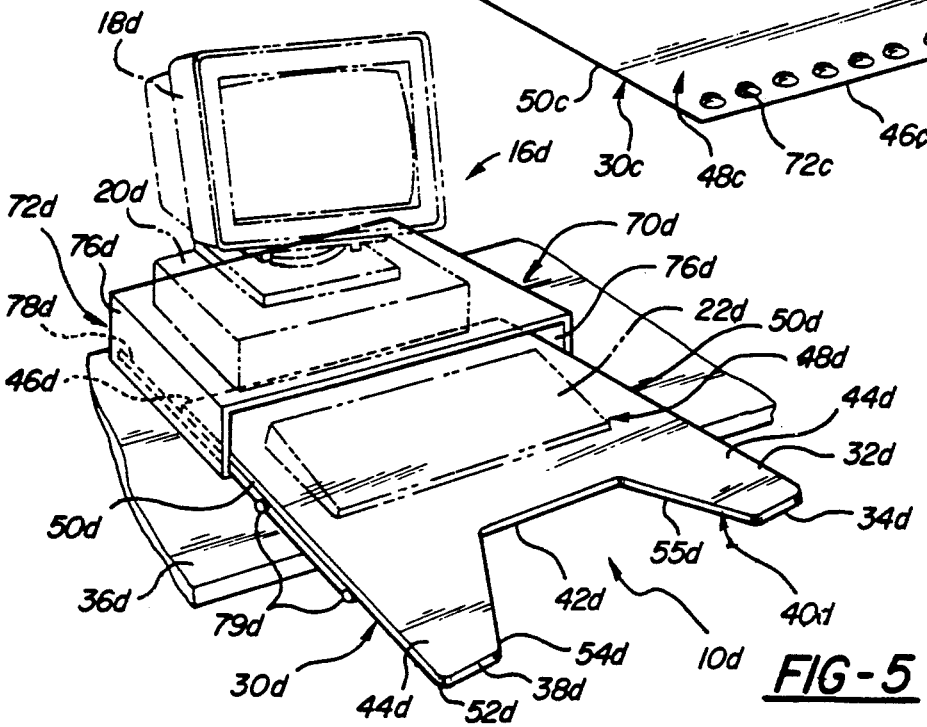
FIG. 5 is a partially broken away perspective view; of a fourth embodiment of the subject invention.

In the fourth embodiment **70*d* as illustrated in FIG. 5, the member 30*d* is slidably secured within housing means 72*d*. The housing means 72*d* is generally an open-ended rectangular cabinet having opposing and upright sides 76*d* with drawer brackets 78*d* connected thereto. The sides of the member 30*d* include rollers 79*d* extending therefrom for engagement in the brackets 78*d* to allow the member 30*d* to slide into the cabinet 74*d* for hidden storage when unused, and for sliding outwardly therefrom to allow use of the apparatus 10*d* and keyboard 22*d*. The keyboard 22*d* on the member 30*d* at all times during storage and use. The cabinet 72*d* is of a size to house both the member 30*d* and the keyboard 22*d***.

Additionally, as illustrated in FIG. 3, the apparatus 10 may include padding means 80 for providing padding or cushioning between the forearm 12 and the upper surface 32 of the member 30. The padding means 80 may comprise a foam pad 82 made of polyurethane and covered with a cloth or vinyl material 84. The pad 82 complements the shape of the cutout 40 and arms 44 and extends slightly within the rectangular portion 48 adjacent the base edge 42. The keyboard 22 abuts against the inside edge 86 of the pad 82.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A typing armrest apparatus for supporting the forearm of a user utilizing a keyboard of typing equipment, said apparatus comprising:

an integral planar member having an upper supporting surface for receiving typing equipment thereon and a lower surface;

said planar member including a first side edge having a U-shaped cutout therein establishing a base edge extending within said member and a pair of support arms extending from said base edge for supporting the forearms of a user and for providing clearance for the torso of the user between said base and support arms thereof; said planar member including a second side edge extending away from said first side edge and integral therewith; said upper and lower surfaces providing flat parallel surfaces for placement on a support surface and for placement of the typing equipment thereon.

2. An apparatus as set forth in claim 1 wherein said planar member is substantially rectangular in shape with said cutout extending in one side thereof.

3. An apparatus as set forth in claim 2 wherein said second side edge extends a width from said first side edge for allowing the typing equipment to be placed thereon.

4. An apparatus as set forth in claim 1 wherein said support arms have a width tapering from said base edge to said first side edge for allowing a greater cutout space at said first side edge with respect to said base edge.

5. A typing armrest apparatus for suppporting the forearm of a user utilizing a keyboard of typing equipment, said apparatus comprising:

an integral planar member having an upper supporting surface for receiving typing equipment thereon and a lower surface;

said planar member including a first side edge having a U-shaped cutout therein establishing a base edge extending within said member and a pair of support arms extending from said base edge for supporting the forearms of a user and for providing clearance for the torso of the user between said base and support arms thereof; said planar member including a second side edge extending away from said first side edge and integral therewith; and connection means adapted to be connected to said second side edge for fixedly maintaining said planar member to a support surface.

6. An apparatus as set forth in claim 5 further including housing means for slidably containing asid planar member therein.

7. An apparatus as set forth in claim 5 wherein said connection means includes apertures extending through said second side and fasteners received in said apertures and adapted to be secured within in apertures of the support surface for securing said planar member to the support surface.

8. An apparatus as set forth in claim 5 wherein by said connection means includes a bracket fixedly connected to and extending from said second side, and clamp means for clamping said bracket fixedly to the support surface.

9. An apparatus as set forth in claim 5 said lower surface includes suction means connected thereto for placement against and suction to the support surface to maintain said member thereagainst.

10. An apparatus as set forth in claim 6 whereins said housing means including opposing side walls and an upper wall for supporting the terminal of the typing equipment, said side walls including sliding brackets connected thereto for slidably receiving said planar member therein and for allowing sliding movement of said member into and out of said housing means.

* * * * *